US005482112A

United States Patent [19]

Sasaki et al.

[11] Patent Number: 5,482,112

[45] **Date of Patent: * Jan. 9, 1996**

[54] CONDENSER

[75] Inventors: Hironaka Sasaki; Ryoichi Hoshino; Takayuki Yasutake, all of Oyamashi, Japan

[73] Assignee: Showa Aluminum Kabushiki Kaisha, Osaka, Japan

[ * ] Notice: The portion of the term of this patent subsequent to May 2, 2006, has been disclaimed.

[21] Appl. No.: 341,428

[22] Filed: Nov. 17, 1994

Related U.S. Application Data

[63] Continuation of Ser. No. 16,475, Feb. 10, 1993, abandoned, which is a continuation of Ser. No. 614,016, Nov. 14, 1990, abandoned, which is a continuation of Ser. No. 358,821, May 30, 1989, abandoned, which is a continuation-in-part of Ser. No. 328,896, Mar. 27, 1989, Pat. No. 4,936,379, which is a division of Ser. No. 77,815, Jul. 27, 1987, Pat. No. 4,825,941.

[30] Foreign Application Priority Data

| | | | |
|---|---|---|---|
| Jul. 29, 1986 | [JP] | Japan | 61-179763 |
| Nov. 4, 1986 | [JP] | Japan | 61-263138 |
| Sep. 14, 1988 | [JP] | Japan | 63-120820 |

[51] Int. Cl.[6] ..... F28B 1/06; F28F 1/02

[52] U.S. Cl. ..... 165/110; 165/146; 165/150; 165/173; 165/177

[58] Field of Search ..... 165/110, 146, 165/134.1, 150, 153, 174, 176, 177, 906

[56] References Cited

U.S. PATENT DOCUMENTS

| | | | |
|---|---|---|---|
| 131,779 | 10/1872 | Pitts et al. | 165/146 |

(List continued on next page.)

FOREIGN PATENT DOCUMENTS

| | | | |
|---|---|---|---|
| 65546 | 8/1947 | Denmark | 165/174 |
| 0002687 | 7/1979 | European Pat. Off. . | |
| 0138435 | 4/1985 | European Pat. Off. . | |
| 0219974 | 4/1987 | European Pat. Off. . | |
| 0255313 | 10/1990 | European Pat. Off. . | |
| 1265756 | 8/1960 | France | 165/176 |
| 1431920 | 2/1966 | France . | |
| 2287963 | 5/1976 | France . | |
| 2367996 | 5/1978 | France . | |
| 2390694 | 12/1978 | France . | |
| 2478807 | 9/1981 | France . | |
| 2574175 | 6/1986 | France . | |
| 2129965 | 12/1971 | Germany . | |
| 2025207 | 12/1971 | Germany | 165/176 |
| 2238858 | 3/1973 | Germany . | |
| 3005751 | 8/1981 | Germany . | |
| 3206298 | 10/1982 | Germany . | |
| 3423746 | 1/1986 | Germany . | |
| 3536325 | 5/1986 | Germany . | |
| 2603968 | 8/1987 | Germany . | |
| 48-49054 | 7/1973 | Japan . | |
| 48-100746 | 12/1973 | Japan . | |
| 49-114145 | 10/1974 | Japan . | |
| 54-17158 | 2/1979 | Japan . | |
| 55-10072 | 1/1980 | Japan . | |
| 55-72795 | 5/1980 | Japan . | |
| 55-100963 | 7/1980 | Japan . | |
| 56-149295 | 11/1981 | Japan . | |
| 57-38169 | 3/1982 | Japan . | |
| 57-66389 | 4/1982 | Japan . | |
| 57-87576 | 6/1982 | Japan . | |

(List continued on next page.)

OTHER PUBLICATIONS

Patent abstract of Japan, vol. 8, No. 76 (M–288) [1513], 9th Apr. 1984; & JA–A–58 221 393.

*Primary Examiner*—Allen J. Flanigan

[57] ABSTRACT

A condenser particularly for use in automobile air conditioning system, the condenser including a pair of headers having their inner spaces divided by partitions so as to form a cooling medium flow path in a zigzag patterns including an inlet side group of paths and an outlet side group of paths, side group of paths is 30 to 60% of that of the inlet side group of paths.

5 Claims, 5 Drawing Sheets

U.S. PATENT DOCUMENTS

| | | | |
|---|---|---|---|
| 1,078,271 | 11/1913 | Force et al. . | |
| 1,438,596 | 12/1922 | Harding . | |
| 1,958,226 | 5/1934 | Askin | 257/255 |
| 2,004,390 | 6/1935 | Benzinger | 165/176 X |
| 2,200,788 | 5/1940 | Coy | 257/28 |
| 2,310,234 | 2/1943 | Haug | 165/174 |
| 2,573,161 | 10/1951 | Tadewald | 257/130 |
| 2,867,416 | 1/1959 | Lieberherr | 165/176 X |
| 3,307,622 | 3/1967 | Oddy | 165/151 |
| 3,310,869 | 3/1967 | LaPorte et al. | 29/157.3 |
| 3,416,600 | 12/1968 | Fink | 165/175 |
| 3,524,500 | 8/1970 | Benjumeda et al. | 165/129 |
| 3,675,710 | 7/1972 | Ristow | 165/1 |
| 3,689,972 | 9/1972 | Mosier et al. | 29/157.3 |
| 3,759,321 | 9/1973 | Ares | 165/125 |
| 3,860,038 | 1/1975 | Forni | 138/94.3 |
| 3,976,126 | 8/1976 | Ruff | 165/110 |
| 4,141,409 | 2/1979 | Woodhull, Jr. et al. | 165/110 |
| 4,201,263 | 5/1980 | Anderson | 165/146 |
| 4,209,059 | 6/1980 | Anthony et al. | 165/1 |
| 4,330,034 | 5/1982 | Lang et al. | 165/113 |
| 4,332,293 | 6/1982 | Hiromatsu | 165/153 |
| 4,443,921 | 4/1984 | Allemandou | 29/157.3 |
| 4,569,390 | 2/1986 | Knowlton et al. | 165/149 |
| 4,570,700 | 2/1986 | Ohasa et al. | 165/134.1 |
| 4,615,385 | 10/1986 | Saperstein et al. | 165/175 |
| 4,688,311 | 8/1987 | Saperstein et al. | 29/157.3 |
| 4,693,307 | 9/1987 | Scarselletta | 165/152 |
| 4,730,669 | 3/1988 | Beasley et al. | 165/151 |
| 4,766,953 | 8/1988 | Grieb et al. | 165/177 |
| 4,825,941 | 5/1989 | Hoshino et al. | 165/110 |
| 4,887,580 | 3/1991 | Guntley et al. | 165/133 |
| 4,998,580 | 3/1991 | Guntly et al. | 165/133 |

FOREIGN PATENT DOCUMENTS

| | | |
|---|---|---|
| 57-198992 | 12/1982 | Japan . |
| 60101483 | 6/1983 | Japan . |
| 58-221390 | 12/1983 | Japan . |
| 59-19880 | 6/1984 | Japan . |
| 59-173693 | 10/1984 | Japan . |
| 59-37564 | 10/1984 | Japan . |
| 59-181997 | 12/1984 | Japan . |
| 60-91977 | 6/1985 | Japan . |
| 60-191858 | 12/1985 | Japan . |
| 61-114094 | 5/1986 | Japan . |
| 61-93387 | 5/1986 | Japan . |
| 61-179763 | 7/1986 | Japan . |
| 1601954 | 11/1981 | United Kingdom . |
| 2090652 | 7/1982 | United Kingdom . |
| 2167850 | 6/1986 | United Kingdom . |
| WO8401208 | 3/1984 | WIPO . |

CONDENSER

This application is a continuation, of application Ser. No. 016,475, filed Feb. 10, 1993, now abandoned, which is a continuation of Ser. No. 614,016, filed Nov. 14, 1990, now abandoned, which is a continuation of Ser. No. 358,821, filed May 30, 1989, now abandoned, which is a continuation-in-part of Ser. No. 328,896, filed Mar. 27, 1989 (U.S. Pat. No. 4,936,379), which is a division of Ser. No. 077,815, filed Jul. 27, 1987 (U.S. Pat. No. 4,825,941).

BACKGROUND OF THE INVENTION

The present invention relates to a condenser particularly adapted for use in automobile air conditioning systems.

For such use, a "serpentine" type of condenser is well known and widely used. This condenser is made up of a multi-bored flat tube, commonly called "harmonica" tube, bent in zigzag form, and corrugated fins sandwiched between the bent tube walls. In this way a core is constituted.

The cooling medium path in a condenser is roughly classified into two sections, that is, an inlet side section and an outlet side section. In the inlet side section the cooling medium is still in a gaseous state, and in the outlet side section it becomes liquid. In order to increase the efficiency of heat exchange the area for heat exchange of the inlet side paths should be as large as possible. On the other hand, that of the outlet side paths can be relatively small.

Since the "serpentine" type condenser consists of a single cooling medium path provided by a single pipe, an increase in the area for heat exchange in the inlet side section increases that of the outlet side section. As a whole the size of the condenser becomes large.

The inventors have made an invention relating to a "multi-flow" type condenser instead of the serpentine type, which is disclosed in Japanese Patent Publication (unexamined) No. 63-34466. The multi-flow type condenser includes a plurality of tubes arranged in parallel, corrugated fins sandwiched therebetween, and headers connected to opposite ends of the tubes. The headers have partitions which divide their inner spaces into at least two sections including an inlet side group of paths and an outlet side group of paths, thereby causing the cooling medium to flow in at least one zigzag pattern. The total cross-sectional area of the inlet side group of paths progressively diminishes toward the outlet side group. In this way the inlet side section has an optimum area for accommodating the cooling medium in a gaseous state, and the outlet side section has an optimum area for accommodating the medium in a liquid state. Thus the multi-flow type condenser has succeeded in reducing the size of condensers without trading off the efficiency of heat exchange. However, one problem which arises is determining the portion of the whole path which is divided into the gaseous phase side (i.e. the inlet side section) and the liquid phase side (i.e. the outlet side section) by partitions. Improper proportioning unfavorably affects the efficiency of heat exchange and causes pressure loss on the flow of the cooling medium.

If the area in the outlet side section is insufficiently reduced as compared with that of the inlet side section, it becomes difficult to secure a sufficiently increased cross-sectional area of the inlet side section. As a result, the cooling medium undergoes a larger pressure loss, and the efficiency of heat exchange decreases because of the relatively small area for heat exchange. If, however, the area in the outlet side section is excessively reduced as compared with that of the inlet side section, pressure loss is likely to increase on the flow of the cooling medium. The area for heat exchange of the inlet side section becomes too large, thereby slowing down the flow rate of the cooling medium.

Accordingly, it is an object of the present invention to provide a condenser having cooling medium paths divided in an inlet side section and an outlet side section in an optimum proportion, thereby increasing the efficiency of heat exchange and reducing the pressure loss of a cooling medium.

Other objects and advantages of the present invention will become more apparent from the following detailed description, when taken in conjunction with the accompanying drawings which show, for the purpose of illustration only, one embodiment in accordance with the present invention.

SUMMARY OF THE INVENTION

According to the present invention, there is provided a condenser particularly adapted for use in automobile air conditioning systems. The condenser includes a plurality of flat tubes, corrugated fins sandwiched between the flat tubes, and a pair of hollow headers connected to the ends of the flat tubes. An inlet and an outlet are provided in the headers for introducing a cooling medium into the flat tubes and discharging a used cooling medium.

The headers have their inner spaces divided by partitions so as to form a cooling medium flow path in a zigzag pattern including an inlet side group of paths and an outlet side group of paths. The entire cross-sectional area of the outlet side group of paths is 30 to 60% of that of the inlet side group of paths.

DETAILED DESCRIPTION OF THE PREFERRED EMBODIMENT

Referring to FIGS. 1 to 6, the illustrated condenser includes a plurality of flat tubes 1 stacked in parallel and corrugated fins 2 sandwiched between the flat tubes 1. The terminating ends of the flat tubes 1 are connected to headers 3 and 4.

Figure 2:
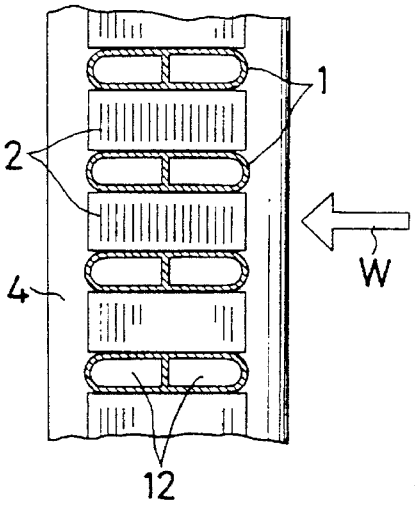
FIG. 2 is a cross-sectional view on an enlarged scale taken along the line 2—2 of FIG. 1.
Figure 3:
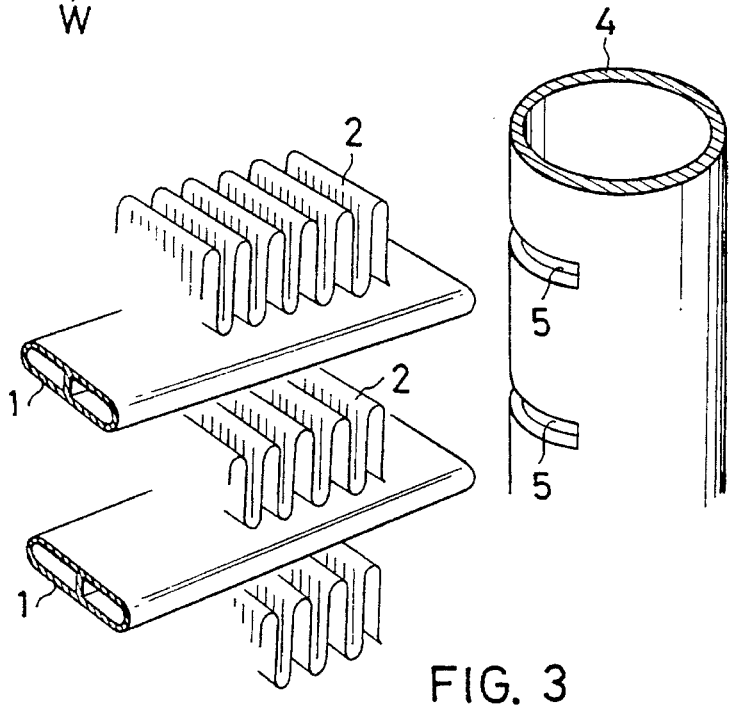
FIG. 3 is an exploded perspective view of the condenser of FIG. 1.
Figure 4:
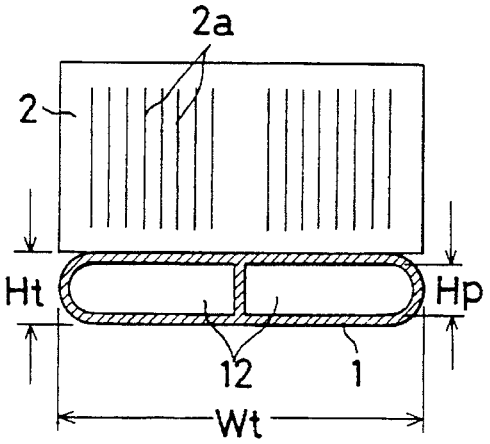
FIG. 4 is a fragmentary cross-sectional view on an enlarged scale showing the flat tube and the corrugated fin when observed in the same direction as in FIG. 3.
Figure 5:
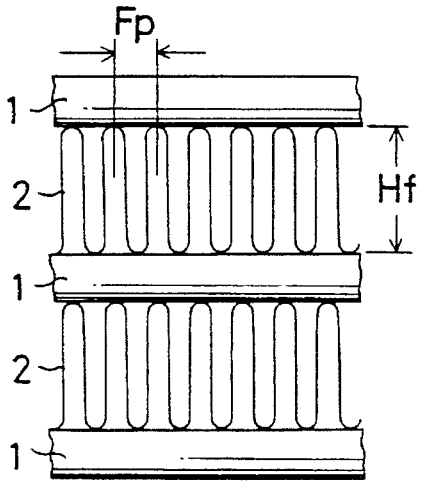
FIG. 5 is a fragmentary front view showing a relationship between the corrugated fins and the flat tubes.

Each flat tube is made of extruded aluminum, having a flat configuration as clearly shown in FIGS. 2 to 4. Alternatively, the flat tubes can be multi-bored flat tubes, commonly called "harmonica tube"; or electrically seamed tubes can be used.

Each corrugated fin 2 has a width identical with that of the flat tube 1. The fins 2 and the flat tubes 1 are brazed to each other. Preferably the fins 2 are provided with louvers 2*a* on the surface.

Figure 1:
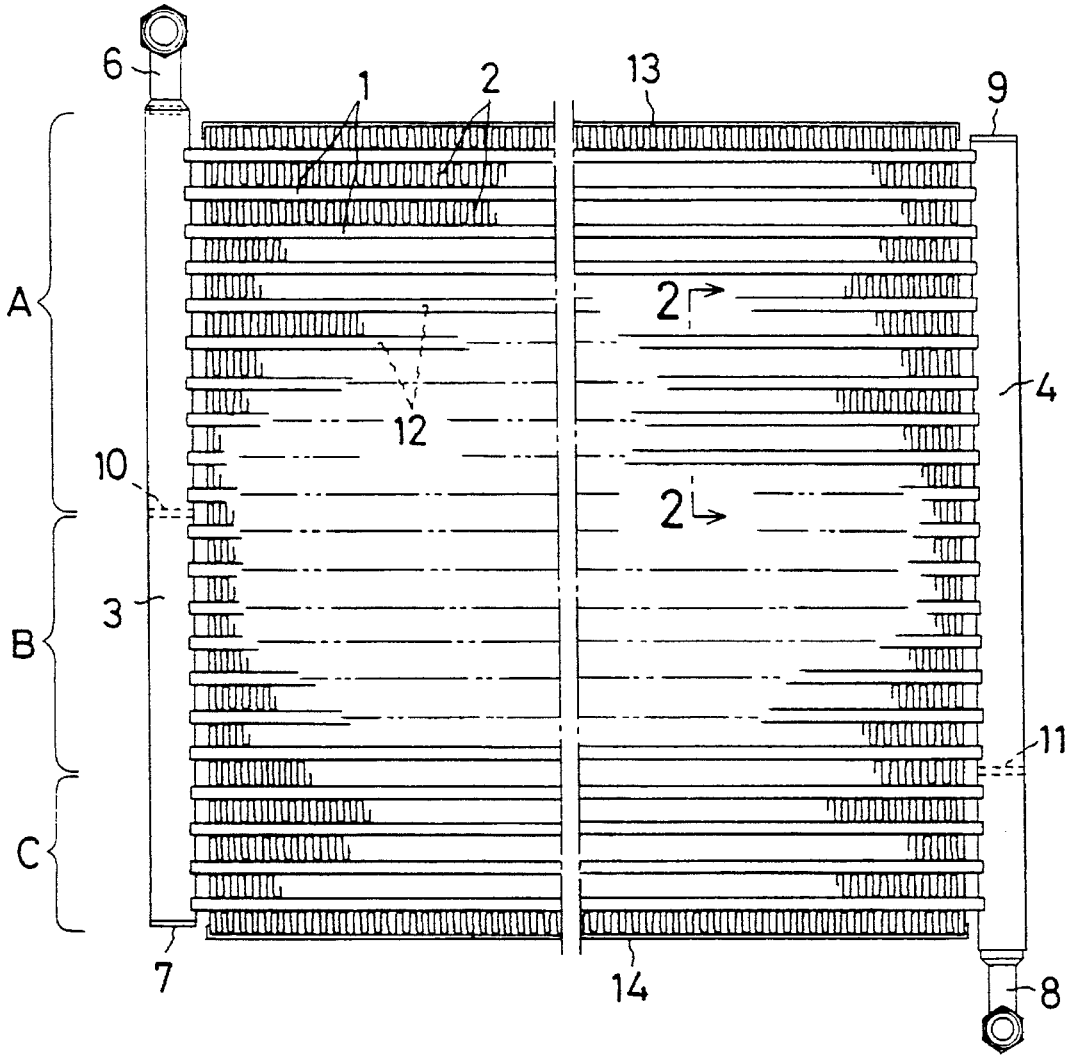
FIG. 1 is a plan view of a condenser according to the present invention.

The headers 3, 4 are made up of electrically seamed pipes of aluminum, and each has holes 5 of the same shape as the cross-section of the flat tubes 1 so as to accept the tube ends la. The inserted tube ends 1*a* are brazed in the holes 5. As shown in FIG. 1, the headers 3 and 4 are connected to an inlet pipe 8 and an outlet pipe 7, respectively. The inlet pipe 8 allows a cooling medium to enter the header 3, and the outlet pipe 8 allows the used cooling medium to discharge. The headers 3 and 4 are closed with covers 7 and 9, respectively. The reference numerals 13 and 14 denote side places attached to the outermost corrugated fins 2.

Figure 6:
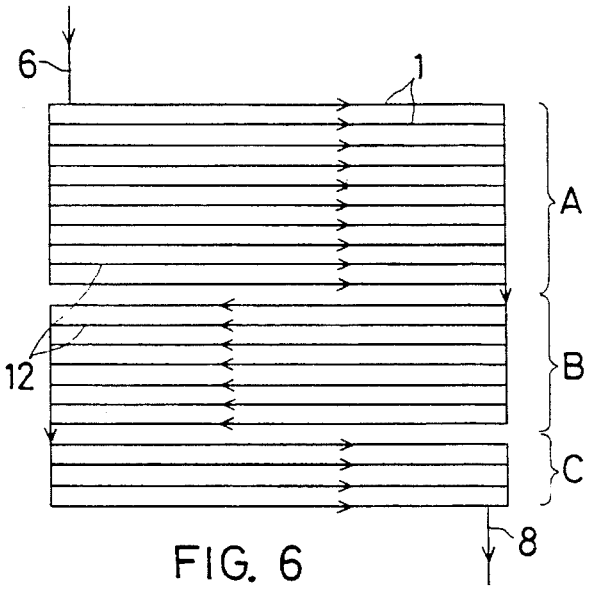
FIG. 6 is a diagrammatic view showing flow patterns of a coolant medium.

The header 3 has its inner space divided by a partition 10 into two sections, and the header 4 also has two sections divided by a partition 11. In this way the whole cooling medium path 12 is divided into an inlet side group (A), an intermediate group (B) and an outlet side group (C) as shown FIGS. 1 and 8. The cooling medium flows in zigzag patterns throughout the groups (A), (B) and (C). As shown in FIG. 6, the intermediate group (B) has a smaller number of flat tubes 1 (that is, paths) than the inlet side group (A), which means that the cross-sectional area of the intermediate group (B) of paths is smaller than that of the group (A). The outlet side group (C) has a smaller number of flat tubes 1 (that is, the number of cooling medium paths) than the intermediate group (B), which means that the cross-sectional area of the outlet side group (C) of paths is smaller than that of the group (B).

Figure 7:
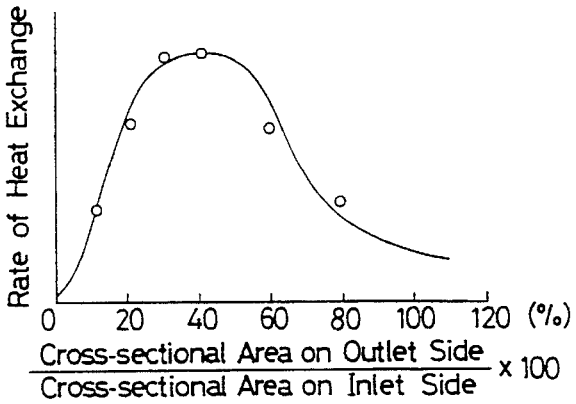
FIG. 7 is a graph showing a relationship between the ratios of cross-sectional area of the outlet side section to the inlet side section and the rate of heat exchange.
Figure 8:
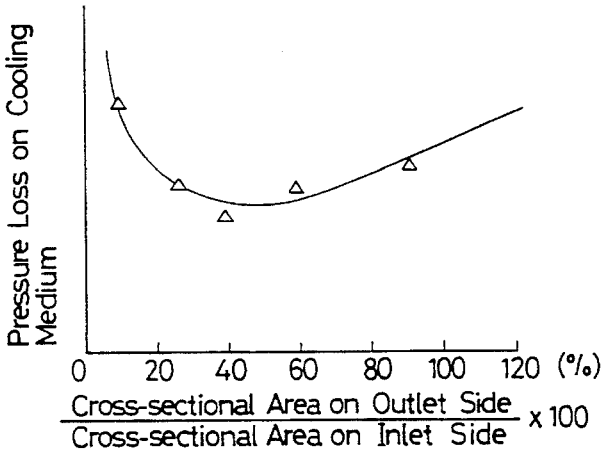
FIG. 8 is a graph showing a relationship between the ratios of cross-sectional area of the outlet side section to the inlet side section and the pressure loss on the cooling medium.

In terms of percentage, the entire cross-sectional area of the outlet side group (C) is 30 to 60% of that of the inlet side group (A). If the percentage less than 30%, the cross-sectional area of the outlet side group (C) becomes small to increase the pressure loss in the cooling medium. At the same time, the cross-sectional area of the inlet side group becomes large to slow down the flow rate of the cooling medium, thereby reducing the efficiency of heat exchange. If the percentage exceeds 60%, the cross-sectional area of the inlet side group (A) becomes small to increase the pressure loss in the cooling medium. In addition, the area for heat transfer is reduced, thereby reducing the efficiency of heat exchange. It is therefore preferred that the entire cross-sectional area of the outlet side group (C) is 30 to 60% of that of the inlet side group (A). It is more preferred that the entire cross-sectional area of the outlet side group (C) is 35 to 50% of that of the inlet side group (A). As shown in FIGS. 7 and 8, this more restricted range exhibits the highest efficiency of heat exchange and the lowest pressure loss in the cooling medium.

As shown in FIG. 8, the cooling medium is introduced into the inlet side group (A) through the inlet pipe 8 and flows therethrough. Then the cooling medium turns from the right-hand header 4 and enters the intermediate group (B). Then it turns from the left-hand header 3 and enters the outlet side group (C). Finally the cooling medium is discharged through the outlet pipe 8. In this way the cooling medium flows in zigzag patterns. Air enters the air paths constituted by the corrugated fins 2 in the direction (W) in FIG. 2. Heat exchange is effected between the air and the cooling medium flowing through the groups (A), (B) and (C). While the cooling medium passes through the inlet side group (A), it is still in a gaseous state and has a relatively large volume. The medium is effectively accommodated in the capacity provided by the paths of the group (A) and keeps contact with the flat tubes 1 in a wide range so that the gaseous cooling medium smoothly condenses and reduces its volume. When the cooling medium flows through the outlet side group by way of the intermediate group (B), it becomes completely liquid, and has such a reduced volume as to be accommodated in a relatively small cross-sectional area of the outlet side group (C). Thus the pressure loss is minimized, thereby enhancing the efficiency of heat exchange.

Figure 9:
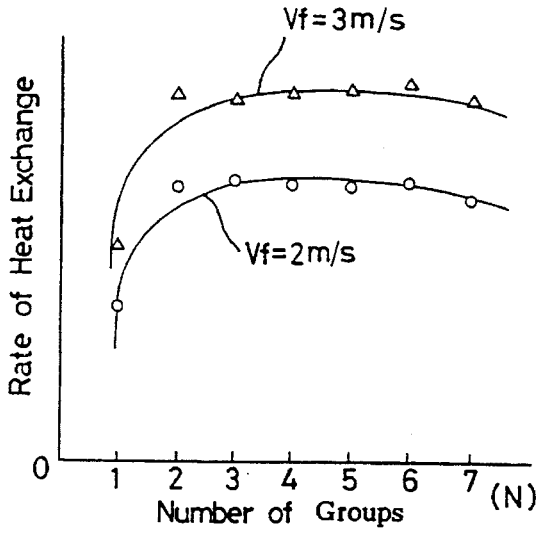
FIG. 9 is a graph showing a relationship between the number of cooling medium paths and the rate of heat exchange.
Figure 10:
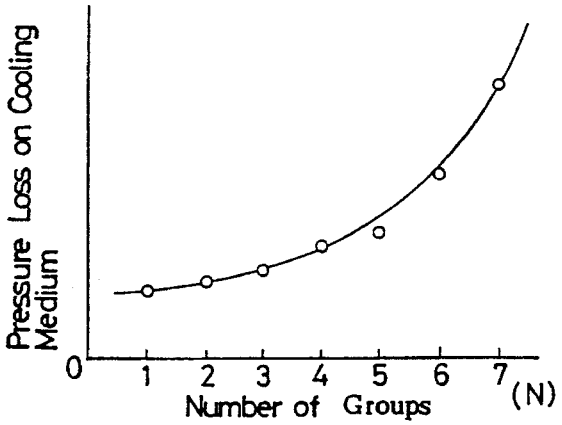
FIG. 10 is a graph showing a relationship between the number of cooling medium paths and the pressure loss on the cooling medium.
Figure 11:
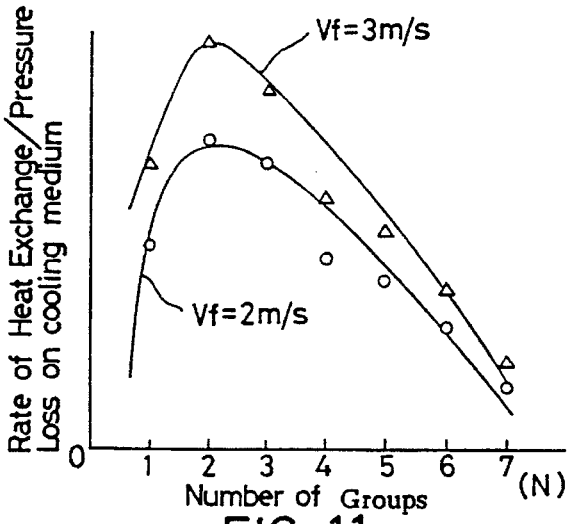
FIG. 11 is a graph showing a relationship between the number of cooling medium paths, the rate of heat exchange and the pressure loss on the cooling medium.

The illustrated embodiment has three groups (A), (B) and (C), but the number (N) of groups is not limited to it. Preferably the number (N) is 2 to 5 groups for the reason explained below:

FIGS. 9 to 11 show the results obtained by experiments in which condensers having twenty-four flat tubes are employed, each having a different number of groups. A cooling medium is introduced into each of the condensers at the same flow rate. Each graph shows the resulting rate of heat exchange and pressure loss in the cooling medium and changes in the rate of heat exchange and pressure loss with respect to the ratio of the outlet side group to the inlet side group. Throughout the experiments the inlet side group, the intermediate group and the outlet side group have the same cross-sectional area. FIG. 9 shows the rates of heat exchange achieved when the speed of wind Vf is 2 m/sec and when it is 3 m/sec each in front of the condenser. It will be understood from FIG. 9 that when the number (N) of the groups is less than 2 the rate of heat exchange is low, whereas when it exceeds five, the rate of heat exchange gradually diminishes. It will be understood from FIG. 10 that as the number (N) of groups increases, the pressure loss in the cooling medium increases, especially when the number (N) exceeds five, it abruptly increases. It will be understood from FIG. 11 that if the number (N) of the groups is less than two, the pressure loss is low, but the rate of heat exchange is also low. Therefore the ratio of the rate of heat exchange to the pressure loss becomes low, which indicates that there is an imbalance between the pressure loss and the rate of heat exchange. If the number (N) of the groups exceeds five, the rate of heat exchange becomes relatively high but the pressure loss becomes low. The ratio between them is low, thereby causing an imbalance between the pressure loss and the rate of heat exchange.

As is evident from the results of the experiments, when the number (N) of the groups is 2 to 5, the rate of heat exchange is high, and the pressure loss in the cooling medium is low. Thus the ratio between them is well balanced. As described above, the cross-sectional area of the outlet side group (C) is 30 to 60% of that of the inlet side group (A). In addition, the number (N) of the group is 2 to 5, which enhances the efficiency of the heat exchange as a result of the reduced pressure loss.

It is preferred that the width (Wt) of each flat tube 1 is in the range of 6.0 to 20 mm. The height (Ht) thereof is in the range of 1.5 to 7.0 mm. The height (Hp) of the cooling medium paths 12 in the flat tubes 1 is 1.0 mm or more. It is also preferred that the height (Hf) of the corrugated fins 2 or a distance between the adjacent flat tubes 1 is in the range of 6 to 16 mm and that the fin pitch (Fp) is in the range of 1.6 to 4.0 mm. The reasons why the above-mentioned ranges are preferable will be described below:

The width (Wt) of each flat tube 1 is preferably in the range of 6.0 to 20 mm.

Figure 12:
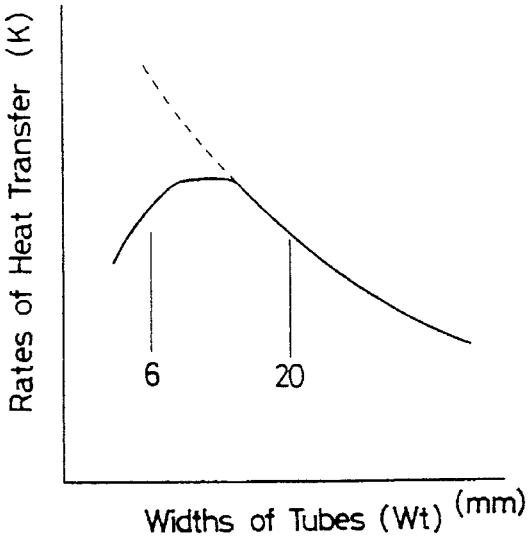
FIG. 12 is a graph showing a relationship between the widths of flat tubes and the rate of heat transfer.
Figure 13:
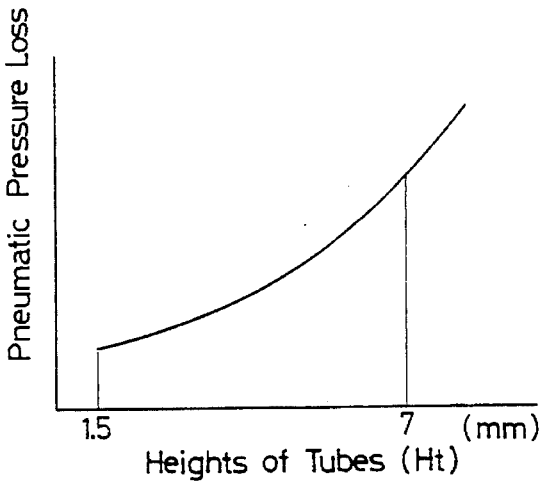
FIG. 13 is a graph showing a relationship between the heights of flat tubes and the pneumatic pressure loss.

As is evident from FIG. 12, if the width (Wt) of the flat tubes 1 is less than 6.0 mm, the corrugated fins 2 sandwiched therebetween will be accordingly narrow in width. The narrow width of the corrugated fins 2 limit the size and number of the louvers 2*a*, which decreases the efficiency of heat exchange. If the width (Wt) of the flat tubes 1 exceed 20 mm, the corrugated fins 2 sandwiched therebetween will accordingly become large. The large fins increases a drag on the flowing air. In addition, the large fins increases the weight of the condenser. It is therefore preferred that the width (Wt) of the flat tubes is in the range of 6.0 to 20 mm; more preferably 6.0 to 16 mm. The optimum range is 10 to 14 mm.

The height (Ht) of each flat tube 1 is preferably in the range of 1.5 to 7.0 mm. If it exceeds 7.0 mm, the pressure loss in the air flow increases. If it is less than 1.5 mm, it is difficult to increase the height (Hp) of the air paths by 1.0 mm or more because of the limited thickness of the flat tubes. It is therefore preferred that it is in the range of 1.5 to 7.0 mm; more preferably 1.5 to 5.0 mm. The optimum range is 2.5 to 4.0 mm.

The height (Hp) of the cooling medium flow paths in the flat tubes 1 is preferably 1.0 mm or more. If it is less than 1.0 mm, the pressure loss in the cooling medium increases, thereby decreasing the rates of heat transfer. It is therefore preferred that it is 1.0 mm or more; more preferably in the range of 1.5 to 2.0 mm.

Figure 14:
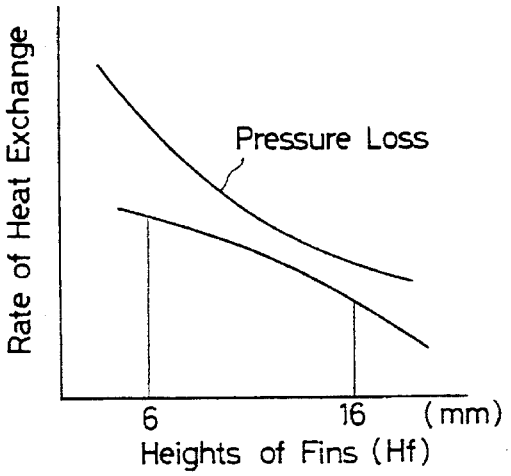
FIG. 14 is a graph showing relationships between the rate of heat exchange and the heights of corrugated fins, and between the pneumatic pressure loss and the heights of corrugated fins.

The height (Hf) of the corrugated fins 2 is preferably in the range of 6.0 to 16 mm. If it is less than 6 mm, the pressure loss in the air will increase as shown in FIG. 14. If it exceeds 18 mm, the number of total fins decreases, thereby reducing the efficiency of heat exchange. It is therefore preferred that it is in the range of 6.0 to 16 mm; more preferably, 8 to 16 mm. The optimum range is 8.0 to 12 mm.

Figure 15:
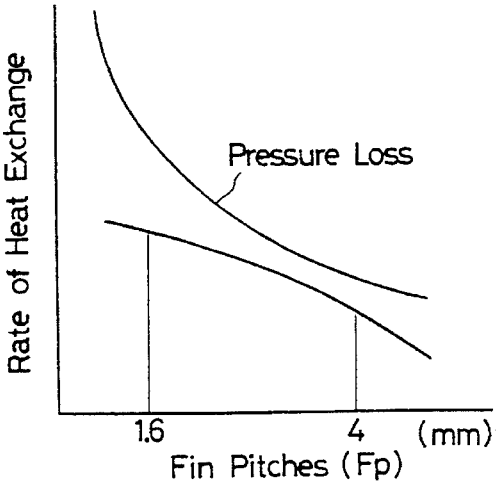
FIG. 15 is a graph showing relationships between the rate of heat exchange and the pitches of corrugated fins, and between the pneumatic pressure loss and the pitches of corrugated fins.

As shown in FIG. 15, the fin pitches are preferably in the range of 1.6 to 4.0 mm. If they are less than 1.6 mm, the louvers 2*a* interfere with the flow of the air, thereby increasing the pressure loss in the air flow. If they exceed 4.0 mm, the efficiency of heat exchange decreases. It is therefore preferred that it is in the range of 1.6 to 4.0 mm; more preferably 1.6 to 3.2 mm. The optimum range is 2.0 to 3.2 mm.

As is evident from the foregoing description, flat tubes, corrugated fins, and headers form the condenser of the present invention in which the widths and heights of the flat tubes, the heights of the cooling medium flow paths, the heights and pitches of the fin are determined at optimum values, thereby reducing the pressure losses which the air and the cooling medium undergo. As a result the efficiency of heat exchanger is enhanced.

In the illustrated embodiment the cross-sectional area of the cooling medium paths 12 progressively diminishes from the inlet side group to the outlet side group through the intermediate group. However it is possible to modify it to an embodiment in which the inlet side group and the intermediate group have the same cross-sectional area which is larger than that of the outlet side group. In the illustrated embodiment the reduction in the cross-sectional area is effected by reducing the number of the flat tubes, but it is possible to reduce the cross-sectional areas of the individual flat tubes without changing the number thereof. The headers 3 and 4 are provided at their erected postures between which the flat tubes 1 are horizontally stacked one above another, but it is possible to modify it to an embodiment in which the headers 3 and 4 are positioned up and down between which the flat tubes are vertically arranged in parallel.

What is claimed:

1. A condenser for liquefying gaseous coolant in an air conditioning system of an automobile after the system has compressed the coolant, said condenser comprising:

(i) a plurality of flat tubular elements defining flow paths and disposed in a spaced, substantially parallel relation, each element including at least one inside wall;

(ii) a plurality of fin members, each fin member disposed between adjacent tubular elements;

(iii) a pair of headers disposed in a spaced, substantially parallel relation at opposite ends of the tubular elements, the one and/or the other header defining a coolant inlet and a coolant outlet for the condenser, each header being an elongate member and defining, for each tubular element, an opening through which it receives the tubular element and establishes fluid communication with the element;

(iv) at least one partitioning plate mounted in one of the headers transversely of the header to divide the inside opening of the header, said plate including a first portion which extends into a slit in the header and a second portion which is generally co-extensive with the inside opening of the header, said second portion of the partitioning plate being without any perforations;

the coolant flowing from the inlet into one header and making a first pass through a plurality of the tubes to the other header, the coolant also making a final pass through a plurality of tubes to the outlet, the tubular elements and headers forming a first zone which receives gaseous coolant from the inlet and a final zone through which the coolant flows before discharging through the outlet, the effective cross sectional area of the flow paths defined by the tubular elements through which the coolant makes the final pass being 30 to 60% of the effective cross sectional area of the flow paths of those through which the coolant makes the first pass; said condenser being able to resist internal pressures greater than 10 atmospheres;

each flat tubular element having the following dimensions:

width: 6.0 to 20 mm height: 1.5 to 7.0 mm height of each cooling medium flow path: 1.0 mm or more;

the fin members having the following dimensions:

height: 6.0 to 16 mm fin pitch: 1.6 to 4.0 mm.

2. A condenser as defined in claim 1, wherein each flat tubular element has the following dimensions:

width: 6.0 to 16 mm height: 1.5 to 5.0 mm height of each cooling medium flow path: 1.0 mm or more and wherein the fin members have the following dimensions:

height: 8.0 to 16 mm fin pitch: 1.6 to 3.2 mm.

3. A condenser as defined in claim 1, wherein each flat tubular element has the following dimensions:

width: 10 to 14 mm height: 2.5 to 4.0 mm height of each cooling medium flow path: 1.5 to 2.0 mm and wherein the fin members have the following dimensions:

height: 8.0 to 12 mm fin pitch: 2.0 to 3.2 mm.

4. A condenser as defined in claim 1, wherein the fin members are provided with louvers on their surface.

5. A condenser as defined in claim 1, wherein each hollow header has a partitioning plate so that the flow path of the cooling medium is divided into at least three groups of the heat exchanging tubular elements in such a manner that one or more intermediate groups are interposed between one and the other groups respectively located near the inlet and outlet of the condenser, whereby the cooling medium flows sequentially through the groups of the flat tubes in a meandering manner thus making three or more passes.

* * * * *